US006209620B1

(12) United States Patent
Pleschiutschnigg

(10) Patent No.: US 6,209,620 B1
(45) **Date of Patent: *Apr. 3, 2001**

(54) METHOD AND APPARATUS FOR PRODUCING COATED HOT-ROLLED AND COLD-ROLLED STRIP

(75) Inventor: Fritz-Peter Pleschiutschnigg, Duisburg (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/115,874

(22) Filed: Jul. 15, 1998

(30) Foreign Application Priority Data

Jul. 19, 1997 (DE) ..... 197 31 124

(51) Int. Cl.[7] ..... B22D 23/04; B22D 11/06

(52) U.S. Cl. ..... 164/461; 164/475; 164/477; 164/480; 164/417; 164/418; 164/419; 164/428

(58) Field of Search ..... 164/461, 419, 164/475, 415, 417, 418, 428, 480, 477

(56) References Cited

U.S. PATENT DOCUMENTS 5,427,172 * 6/1995 Ekerot ..... 164/461
5,816,311 * 10/1998 Osada ..... 164/415
5,855,238 * 1/1999 Pleschintschnigg et al. ..... 164/461

* cited by examiner

*Primary Examiner*—Harold Pyon
*Assistant Examiner*—I. H. Lin
(74) *Attorney, Agent, or Firm*—Friedrich Kueffner

(57) ABSTRACT

A method for producing coated hot-rolled or cold-rolled products, particularly steel strip, and an apparatus for carrying out the method, wherein thin strip is cast especially by a travelling mold and the cast strip is guided on-line as a master strip into an inversion casting plant for strip coating, the surface of the coated strip is smoothed with rolls, and if necessary, the thickness of the coated and smoothed strip is reduced in a rolling process. The apparatus includes a strip casting plant, particularly with a travelling mold for producing a thin strip, an inversion casting plant arranged on-line following the strip casting plant for coating the thin strip or master strip from the strip casting plant, at least one pair of smoothing rolls arranged following the inversion casting plant for smoothing the surface of the coated strip emerging from the inversion casting plant, and, if necessary, a subsequently arranged rolling mill for a reducing deformation of the coated and smoothed strip to the strip thickness to be produced.

25 Claims, 2 Drawing Sheets

METHOD AND APPARATUS FOR PRODUCING COATED HOT-ROLLED AND COLD-ROLLED STRIP

BACKGROUND OF THE INVENTION

1. Field of the Invention

The present invention relates to a method for producing coated hot-rolled or cold-rolled products, particularly steel strip. The invention also relates to an apparatus for carrying out the method.

2. Description of the Related Art

For producing hot-rolled and cold-rolled strip preferably of steel in the field of casting methods with approximate final dimensions, the Bessemer two-roller method is known in the art. On the other hand, also known in the art is the inversion casting method (EP-B1-0 311 602; DE C1-43 19 569; DE C1-195 09 681; as well as dissertation of Dr. Vonderbank and Dr. Hamacher/RWTH Aachen, Institut für Eisenhüittenkunde, 1995).

The Bessemer two-roller method is today used preferably for casting stainless steel but also carbon steel. However, in the case of casting thicknesses of 10 to 2 mm and widths of 500 to 1,800 mm, it is difficult to adhere to a tolerance of the thickness profile over the width of, for example, <1% at the cast product. This desired profile which is required by the market must be adhered to by percentage during casting because, due to the high flux resistance in transverse direction, an improvement of the profile in the roll gap of a roll stand cannot take place.

For practical purposes, it can be stated that, in the case of a width to thickness ratio of >100, a transverse flux in the roll gap of a roll stand does not take place and, thus, a profile improvement cannot be carried out. The production results with the two-roller method and also with other strip casting methods on the basis of wall molds confirm that the thickness deviations in the width direction (profile) as well as in the casting or rolling direction (planarity) are outside of the tolerance for plates required by the steel market.

For example, strip material, preferably of stainless steel, which in the past has been produced on the basis of travelling molds and particularly, for example, on the basis of the Bessemer two-roller method, which up to now is used most widely by numerous strip casting techniques on the basis of travelling molds, can only be utilized for punched products which do not have a high requirement with respect to planarity in the width direction as well as in the rolling direction.

Another strip casting method not based on travelling molds is the inversion casting method. In that case, a thin strip, called master or starting strip, is continuously guided through a melt in a crystallizer over a controlled period of time. Taking into consideration the temperature of the master strip when entering the melt, for example, room temperature or also, for example, 800° C. and the temperature of the melt, expressed as overheating temperature X in ° C. ($T_{actual}=T_{li}+X°$ C.), during the dwell time of the master strip in the melt a controllable quantity of melt, also called secondary material, crystallizes onto the master strip.

Depending on the above-described parameters, this crystallization of the secondary material onto the master strip, which may have an initial thickness of, for example, between 0.5 to 10 mm, is between 5 and 500%.

Thus, a high percentage crystallization of, for example, 500% occurs onto a cold and thin master strip (e.g. room temperature 20° C. 1 mm thickness), with a low overheating temperature of, for example X=15° C. and a long dwell time of, for example, 2.5 sec. On the other hand, a minimum coating of, for example, 5–10% can be achieved on a master strip preheated to, for example, 600 to 800° C. and with a thickness of, for example, 2 to 5 mm, with a relatively high overheating of, for example, X>15° C. and a short dwell time of, for example 1 sec.

This inversion casting method can be utilized for monomaterials as well as for composite materials and has the significant advantage of providing the possibility of producing a planarity as it is required by the steel market of strips and plates, for example, with a profile <1%, by a smoothing roll pair mounted above the melt or above the crystallizer, as disclosed in DE-C1-43 19 569.

However, when used as a casting method, the inversion casting method requires the partially necessary return of the rolled finished product of, for example, 1%, for maintaining a stock of master strip of 2 days or 4,000 t in the case of an annual casting capacity of 0.6 million t which, in turn, results in an accumulation of defects, for example, oxidic inclusions, in the product which is not acceptable in the long term. This inevitable system-imminent accumulation of defects can only be corrected by using master strip which is purchased from the outside.

Moreover, when coating hot-rolled strip in the range of 50 to 5%, it is necessary to preheat the master strip, for example, to 800° C.

This preheating is technically very complicated when considering that a master strip of, for example, 2 mm is introduced into the melt of the crystallizer with a speed of between 10 and 100 m/min.

Preheating can be carried out, for example, inductively or also with furnace immediately before the master strip enters the crystallizer or also in a shaft within the crystallizer or the melt, as disclosed by DE-C1-195 09 681. This preheating unit must have a high power density, requires a great investment and leads to high operating costs.

SUMMARY OF THE INVENTION

Therefore, it is the primary object of the present invention to provide a method and an apparatus of the above-described type in which the accumulation of system-imminent defects during inversion casting is avoided and which make it possible to achieve the thickness tolerance <1% in width direction (profile) and in the casting or rolling direction (planarity) required by the steel market when using travelling molds, for example, the twin-rollers, and in which the entry temperature of the master strip into the crystallizer or into the melt with subsequent smoothing pass without preheating is freely selectable.

In accordance with the present invention, thin strip is cast especially by means of a travelling mold and the cast strip is guided on-line as a master strip into an inversion casting plant for strip coating, the surface of the coated strip is smoothed with rolls, and if necessary, the thickness of the coated and smoothed strip is reduced in a rolling process.

The apparatus for carrying out the method according to the present invention for producing coated hot-rolled or cold-rolled strip, particularly steel strip, includes a strip casting plant, particularly with a travelling mold for producing a thin strip, an inversion casting plant arranged on-line following the strip casting plant for coating the thin strip or master strip from the strip casting plant, at least one pair of smoothing rolls arranged following the inversion casting plant for smoothing the surface of the coated strip emerging from the inversion casting plant, and, if necessary, a subsequently arranged rolling mill for a reducing deformation of the coated and smoothed strip to the strip thickness to be produced.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
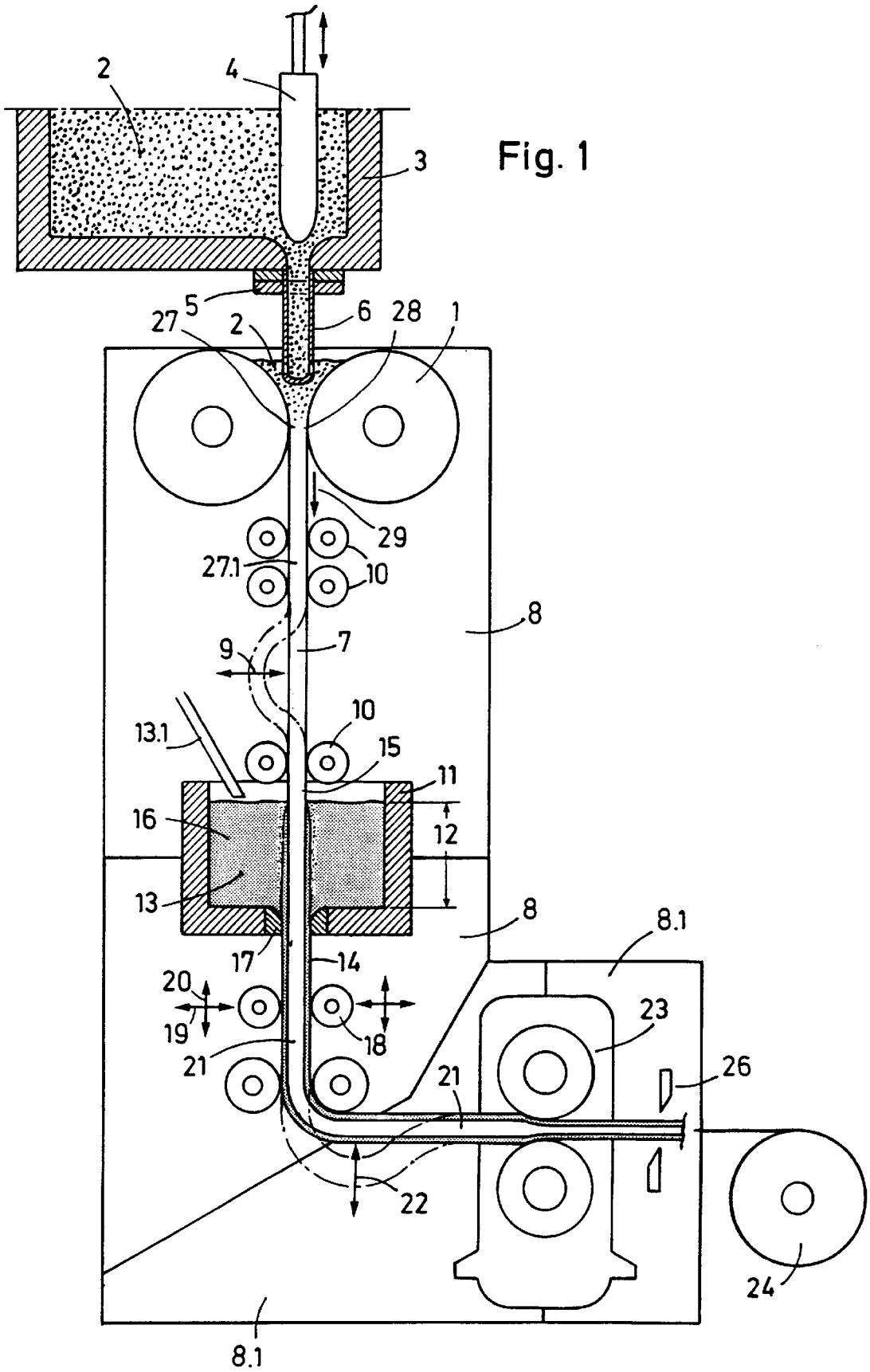
FIG. 1 is a schematic view, partially in section, of an apparatus according to the present invention.

FIG. 1 of the drawing shows a casting and rolling plant composed, for example, of twin rollers as a strip casting plant and of a subsequently arranged inversion casting plant for casting or coating and for the production of monomaterial as well as composite material. The strip cast on the twin rollers emerges controlled with respect to temperature and atmosphere vertically from the top through the melt bath and subsequently through the floor of the crystallizer. The strip coated in the crystallizer is smoothed between the inversion casting plant and the on-line rolling mill.

FIG. 2 of the drawing once again shows a casting and rolling plant as in FIG. 1, except that in the embodiment of FIG. 2 the strip cast, for example, with the twin rollers, travels vertically from below through the floor of the crystallizer of the inversion casting plant and is then guided above the melt bath through the pair of smoothing rolls directly to the rolling mill controlled with respect to temperature and atmosphere.

FIG. 1 shows twin rollers, for example, in accordance with Bessemer. Of course, these twin rollers can be replaced by any other strip casting method on the basis of a travelling mold. The twin rollers are supplied with liquid metal, preferably steel 2, from a distributor 3 with plug 4 or gate regulation 5 and a submerged outlet 6. The twin rollers 1 cast a strip 7 having a thickness of between 10 and 1 mm and a width of between 2,000 and 300 mm with a casting speed of between 10 and 100 m/min.

The strip 7 which emerges from the twin rollers 1 is conducted through a possible loop formation 9 between rollers 10 for guiding the strip directly vertically from above to the inversion casting unit in a temperature and atmosphere controlled manner 8, so that, for example, an oxidation by Ar and/or N is avoided.

During the controlled dwell time of the cast strip or master strip 7 in the melt 13, a controlled layer 14 of secondary material is crystallized onto the master strip 7.

Depending on its entry temperature 15, the overheating temperature 16 (X in ° C.) of the melt 13, the thickness of the master strip 7.1 and the dwell time of the strip 7 in the melt for inversion casting 13, this layer 14 may be between 5–5000% of the thickness of the master strip 7.

When the strip emerges from the floor outlet 17, it is conducted in a temperature and atmosphere controlled manner 8 to the pair of smoothing rolls 18 which are arranged so as to be adjustable with respect to adjustment 19 and distance 20 from the floor outlet 17 in order to adjust a controlled thickness tolerance in the strip width (profile) and the casting or rolling direction (planarity) of, for example, <1%.

The strip 21 which has now been cast and coated and controlled with respect to thickness tolerances, either of a single material (monomaterial) or of several materials (composite material), is now once again directly conducted through the possibility of a loop formation 22 to the rolling mill 23 in a temperature controlled manner and if necessary, an atmosphere controlled manner 8.1, where it is directly finish-rolled and subsequently coiled by the reel 24. The strip lengths are cut by means of the shear 26.

Figure 2:
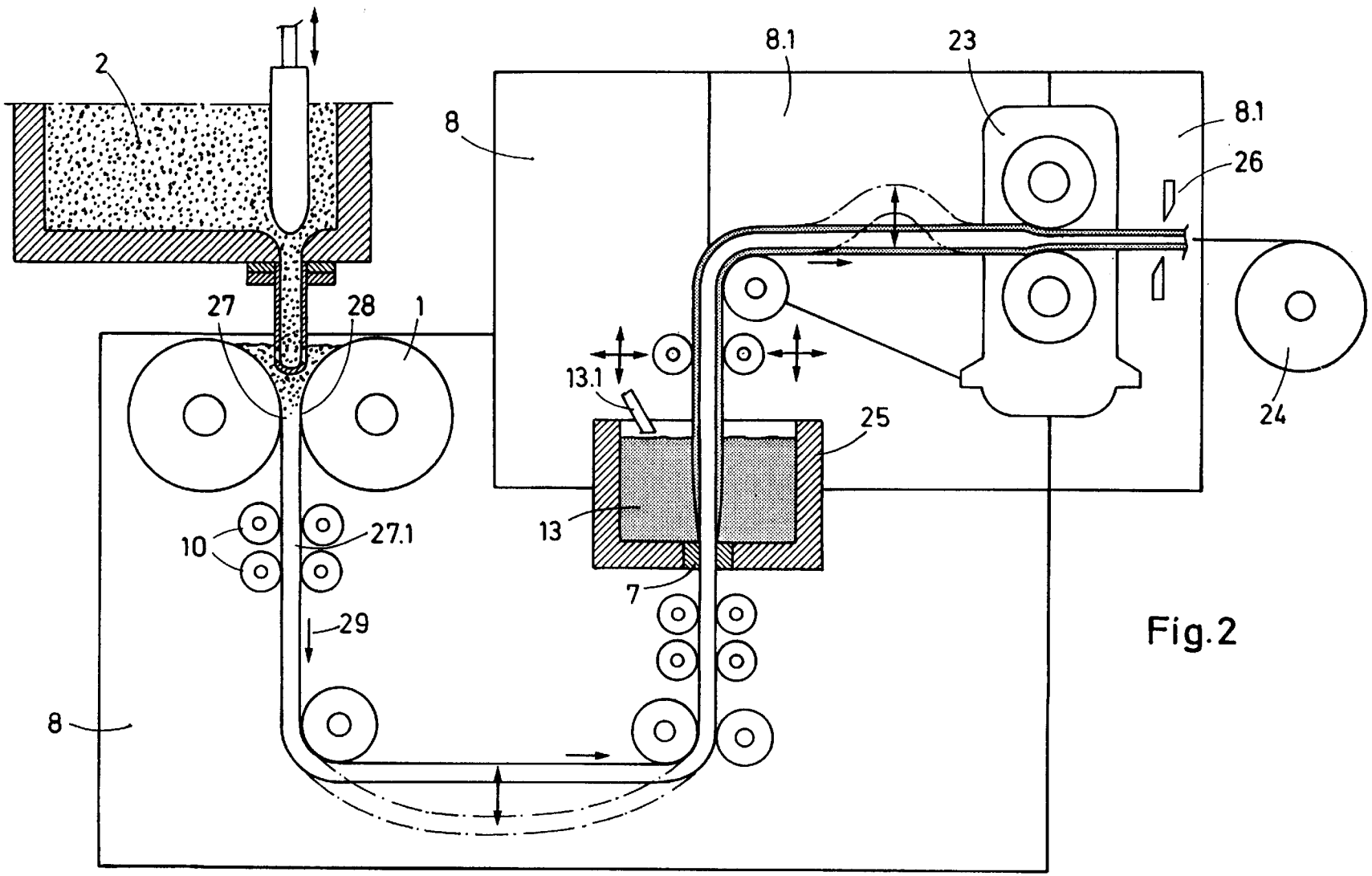
FIG. 2 is a schematic view, partially in section, of another embodiment of the apparatus of the invention.

FIG. 2 of the drawing shows in principle a similar process and a similar apparatus for producing directly by means of a continuous casting plant and by means of a directly integrated inversion casting plant and rolling mill endless strips as monomaterial as well as composite material with high surface quality and internal quality and with controlled thickness, coating, and material composition. The difference between the two FIGS. 1 and 2 is the fact that the same process is carried out by different embodiments of the apparatus.

In FIG. 2, the cast strip or master strip 7 is supplied vertically from below through the floor of the inversion casting plant 25. This type of introducing the cast strip 7 through the bottom opening 7 into the melt 13 of the inversion casting plant constitutes a simpler solution because the strip has a thickness tolerance which is acceptable relative to the sealing of the bottom opening and the strip is not subjected to uncontrolled tension or stress.

The advantages of the above-described invention are a result of the combination of a continuous casting plant on the basis of a travelling mold, such as twin rollers, with an inversion casting plant for coating the cast strip and with a rolling mill. These advantages are:

- the production of hot-rolled or cold-rolled strip which is ready to be sold with a thickness of between 4 and 0.2 mm and a width of between 300 and 2,000 mm in the form of a monomaterial or composite material directly from the liquid phase without the supply of thermal energy from outside;
- the direct production of carbon hot-rolled strip or cold-rolled strip coated with stainless steels;
- a good surface quality with thickness deviations <1% corresponding to the strip tolerances with respect to profile and planarity required by the market;
- a good internal quality as a result of reducing system imminent accumulations of defects, such as oxides;
- the controlled adjustment of the strip temperature prior to entering the inversion casting plant without an energy supply from the outside in order to control or regulate the coating thickness;
- the production of endless strip products and, thus, freely selectable coil weights as hot-rolled strip or cold-rolled strip; and
- very little requirements with respect to equipment and energy for directly producing hot-rolled and/or cold-rolled strip by casting approximate final dimensions.

The invention is not limited by the embodiments described above which are presented as examples only but can be modified in various ways within the scope of protection defined by the appended patent claims.

I claim:

1. A method of producing coated hot-rolled or cold-rolled steel strip, the method comprising casting a thin strip with the use of a travelling mold, guiding the cast strip on-line as a master strip into an inversion casting plant for coating the strip, smoothing the surface of the coated strip by rolling the strip, and reducing the thickness of the coated and smoothed strip in a rolling process as necessary, wherein the produced strip has approximately a thickness of between of 0.2 mm and 6 mm and a width of between 0.3 m and 2 m.

2. The method according to claim 1, the method comprising a combination of the following method steps:

a) connecting a strip casting stage with the travelling mold directly online to;

b) a strip guiding means operating in a temperature-controlled and atmosphere-controlled manner, and subsequently c) introducing the cast strip as a master strip into an inversion casting stage for coating the cast strip;

d) conducting the strip from the inversion casting stage to a temperature-controlled and atmosphere-controlled smoothing rolling stage of the strip for rolling the strip with a controlled tolerance with respect to a thickness thereof in a width direction as well as in a casting or smoothing rolling direction;

e) conducting the strip from the smoothing rolling stage to a rolling stage operating in a temperature-controlled manner and an atmosphere-controlled manner as necessary for producing a desired strip with respect to the thickness thereof as well as a structure thereof;

f) conducting the strip from the rolling stage in a temperature-controlled manner and an atmosphere-controlled as necessary to a strip coiling stage with freely selectable coil weight, whereby g) an endless casting and rolling process is effected between the strip casting stage and the strip coiling stage.

3. The method according to claim 2, comprising producing in the strip casting stage a strip thickness of between 10 and 1 mm and a strip width of between 0.3 and 2 m, producing in the inversion casting stage a strip thickness of between 25 and 1.05 mm, producing in the smoothing rolling stage a strip with a minimum thickness deviation of about 0.2% in the width direction and in the casting direction, and producing in the rolling stage a strip with a thickness of between 0.2 to 6 mm with temperature-controlled structure, wherein the strip is coiled in a temperature-controlled manner endlessly in the strip coiling stage.

4. The method according to claim 2, comprising controlling a temperature and protecting against oxidation the process between the strip casting stage and the strip coating in the inversion casting stage and between the inversion casting stage and the smoothing rolling stage, and subsequently conducting the coated strip in at least a temperature-controlled manner to the rolling stage or the coiling stage.

5. The method according to claim 2, comprising using carbon steel in the strip casting stage and stainless steel in the inversion casting stage.

6. The method according to claim 2, comprising controlling a thickness of a coating crystallized in the inversion casting stage onto the master strip cast in the strip casting stage by controlling the temperature of the cast master strip prior to entering the melt of the inversion casting stage;

controlling an overheating temperature of the melt in the inversion casting stage; and controlling a dwell time of the strip in the melt of the inversion casting stage.

7. The method according to claim 2, wherein liquid steel for the strip casting stage and the melt for inversion casting stage are of the same quality.

8. The method according to claim 2, wherein liquid metals in the strip casting stage and liquid steel in the inversion casting stage are different.

9. The method according to claim 2, comprising using in the strip casting stage and the inversion casting stage exclusively one of carbon steel and stainless steel for producing strip of monomaterial.

10. The method according to claim 9, wherein the monomaterial is produced from a material having a coating of between 200 and 500%.

11. The method according to claim 2, comprising using different metals in the strip casting stage and in the inversion casting stage for producing composite materials.

12. The method according to claim 11, comprising producing a composite material having a coating of between 5 and 100%.

13. An apparatus for producing coated hot-rolled products or cold-rolled steel strip, the apparatus comprising:

a continuous casting plant with a travelling mold for producing a thin strip;

an inversion casting plant arranged downstream of and online with the continuous casting plant for coating the thin strip as master strip from the continuous casting plant;

at least one smoothing roll pair arranged downstream of the inversion casting plant for smoothing the surface of the coated strip emerging from the inversion casting plant;

a subsequent rolling mill as required for a reducing deformation of the coated and smoothed strip to the strip thickness to be produced.

14. The apparatus according to claim 13, wherein the twin rollers are adjustable to effect final solidification at the earliest immediately in front of a narrowest roller position up to outside of the casting plant in a position in casting direction.

15. The apparatus according to claim 13, comprising strip guide rollers arranged following the continuous casting plant for rolling the cast strip.

16. The apparatus according to claim 13, comprising guide means for guiding the cast strip vertically from above through the melt of the inversion casting plant and through a floor opening of the inversion casting plant toward the smoothing roll pair.

17.The apparatus according to claim 13, comprising guide means for guiding the cast strip vertically from below through the melt of the inversion casting plant and through a floor opening of the inversion casting plant toward the smoothing roll pair.

18. The apparatus according to claim 13, wherein the continuous casting plant comprises twin rollers adjustable to a casting speed of 10 to 100 m/min for producing a strip with a thickness of between 10 and 1 mm of steel.

19. The apparatus according to claim 18, comprising underneath the twin rollers between a roller guide means and the inversion casting plant means for looping the strip for regulating the speed and temperature of the strip.

20. The apparatus according to claim 13, wherein a) the continuous casting plant with a travelling mold is configured to cast a strip having a thickness of 1 to 10 mm with a casting speed of between 10 to 100 m/min;

b) a closed space is formed in which the strip as the master strip is conducted in a temperature-controlled and oxidation-protected manner directly from the continuous casting plant to the inversion casting plant, wherein the inversion casting plant is configured to produce a strip having a layer crystallized onto the strip with a thickness of between 5 and 500% relative to the cast master strip;

c) the smoothing roll pair is mounted immediately following the inversion casting plant and is configured to produce a coated strip with a thickness tolerance with respect to profile and planarity of about 0.2% of the thickness thereof up to at most 40 mm next to a strip edge in the width direction and the rolling direction under temperature-controlled conditions and with reoxidation protection by means of a closed space;

d) a temperature-protected transition and reoxidation-protected transition as necessary from the smoothing pair roll to the rolling mill for producing a strip thickness of between 6 and 0.2 mm and a width of 0.3 to 2 m , with temperatures of between 1,200 and 400° C. or room temperature and with austenitic or ferritic structures; and e) further comprising a runout roller table with temperature protection and reoxidation protection as necessary, wherein the runout roller table extends between the rolling and a reel; and f) wherein the reel is configured to coil a freely selectable specific coil weight of a strip of between 5 and 100 kg/mm strip width and with controlled austenitic or ferritic structures.

21. The apparatus according to claim 20, wherein the temperature controlled spaces are comprised of insulation elements and cooling elements.

22. The apparatus according to claim 20, wherein the reoxidation protected spaces each have a Ar and/or $N_2$ connection for flooding.

23. The apparatus according to claim 20, wherein the reoxidation protected spaces are configured to be adjustable to an excess pressure of at most 100 mm water column.

24. The apparatus according to claim 20, comprising means for adjusting the smoothing roll pair with respect to position and distance from the inversion casting plant.

25. The apparatus according to claim 20, comprising between the smoothing roll pair and the rolling mill a loop for regulating the speed and temperature of the strip crystallized onto the master strip.

* * * * *